United States Patent [19]

Gillespie

[11] 4,188,009

[45] Feb. 12, 1980

[54] APPARATUS FOR MOLDING CRAYONS AND THE LIKE

[76] Inventor: Albert C. Gillespie, Box 379 E. Salt Fork Rd. R#1, Lawrenceburg, Ind. 47025

[21] Appl. No.: 906,116

[22] Filed: May 15, 1978

[51] Int. Cl.[2] ..... B22D 27/02

[52] U.S. Cl. ..... 249/78; 264/DIG. 46; 425/DIG. 13; 425/DIG. 110; 425/803

[58] Field of Search ..... 249/78, 200, 199; 425/803, 804, 805, 807, 810, DIG. 32, DIG. 13, DIG. 110; 264/DIG. 46

[56] References Cited

U.S. PATENT DOCUMENTS

| | | | |
|---|---|---|---|
| 479,212 | 7/1892 | Fuchs | 425/439 |
| 869,692 | 10/1907 | Daniel et al. | 425/439 |
| 1,123,667 | 1/1915 | Blanchard | 425/439 |
| 3,166,792 | 1/1965 | Goldfarb | 425/803 |
| 4,082,491 | 4/1978 | Clymer | 425/DIG. 32 |

*Primary Examiner*—Donald J. Arnold
*Attorney, Agent, or Firm*—Frost & Jacobs

[57] ABSTRACT

Apparatus for molding crayons and the like having particular utility in reclamation of broken and worn crayons and molding thereof into new crayons. Means for supplying radiant and convective heat are surrounded by a housing, with a plurality of chutes positioned beneath the heat supply means, each chute having an orifice communicating with a mold cavity into which molten wax flows by gravity. The apparatus has no moving parts and is simple and safe for use by children.

3 Claims, 4 Drawing Figures

APPARATUS FOR MOLDING CRAYONS AND THE LIKE

BACKGROUND OF THE INVENTION

1. Field of the Invention

This invention relates to apparatus for molding crayons and the like. Although not so limited the invention has particular utility in the reclamation of worn and broken crayons, by melting and molding thereof, to form new crayons or other molded shapes.

2. Description of the Prior Art

U.S. Pat. No. 3,166,792, to Goldfarb, discloses a device for molding wax crayons, utilizing wax tablets which may be melted and inserted into a mold. The device is stated to be adapted for use by children "for making crayons in do-it-yourself kits or projects".

U.S. Pat. No. 2,627,089, to Norwood, discloses apparatus including a rotating screw for pushing the starting material through a molding die.

U.S. Pat. No. 3,891,179 discloses a hobby casting mold.

Among earlier patents which relate to mass production of new crayons are U.S. Pat. Nos. 437,751; 536,359; 515,034 and 492,361.

To the best of applicant's knowledge there has been no suggestion in the prior art of apparatus, suitable for use by children, which salvages and converts broken and worn crayons into new crayons.

SUMMARY OF THE INVENTION

It is a principal object of the invention to provide apparatus which is simple and safe for use by children, for the reclamation of broken and worn crayons.

It is a further object of the invention to provide apparatus for melting wax fragments by radiant and convective heat, and for molding the molten wax directly into crayons or other desired configurations,, which apparatus has no moving parts and can be operated by children with minimum instruction and supervision.

The above objects are achieved, in accordance with the present invention, in an apparatus for molding crayons and the like comprising means for supplying radiant and convective heat; a housing surrounding the heat supply means; a plurality of reservoirs positioned beneath the heat supply means, each reservoir comprising a downwardly inclined chute the uppermost end of which projects outwardly from the housing; an orifice in the lowermost, inner end of each chute; a plurality of mold cavities, each cavity having an open upper end positioned beneath and in communication with an orifice; and means for opening said mold cavities for release of molded crayons and the like.

In reclaiming broken and worn crayons and molding thereof into new crayons, the crayon pieces, which ordinarily will be of the same color, are fed into an open uppermost end of a chute in which the pieces are melted and flow by gravity into the lowermost inner end of the chute, through the orifice therein and into the mold cavity which communicates therewith. The chutes and mold cavities are arranged in alignment with but separate from one another, so that a plurality of new crayons, each of different color if so desired, can be moled simultaneously.

The molds are preferably comprised of two opposed, separable mold halves each having half the mold cavities formed in the opposing faces thereof. The mold halves are hingedly joined along one edge thereof and are provided with means for clamping the mold halves together adjacent an opposite edge thereof. When so clamped the half cavities in one mold half register with the half cavities in the other mold half. Release of the clamping means permits the outer mold half to be opened outwardly like a door, so that the newly molded crayons and the like can be removed.

The housing is preferably formed in two sections comprising a base in which are secured the heat supply means, the reservoirs and the mold cavities, and a removable top section which covers and protects the heat supply means. A reflective surface projecting upwardly above the heat supply means is preferably provided and is secured either to the housing base or to the top section.

DESCRIPTION OF THE PREFERRED EMBODIMENTS

Figure 1:
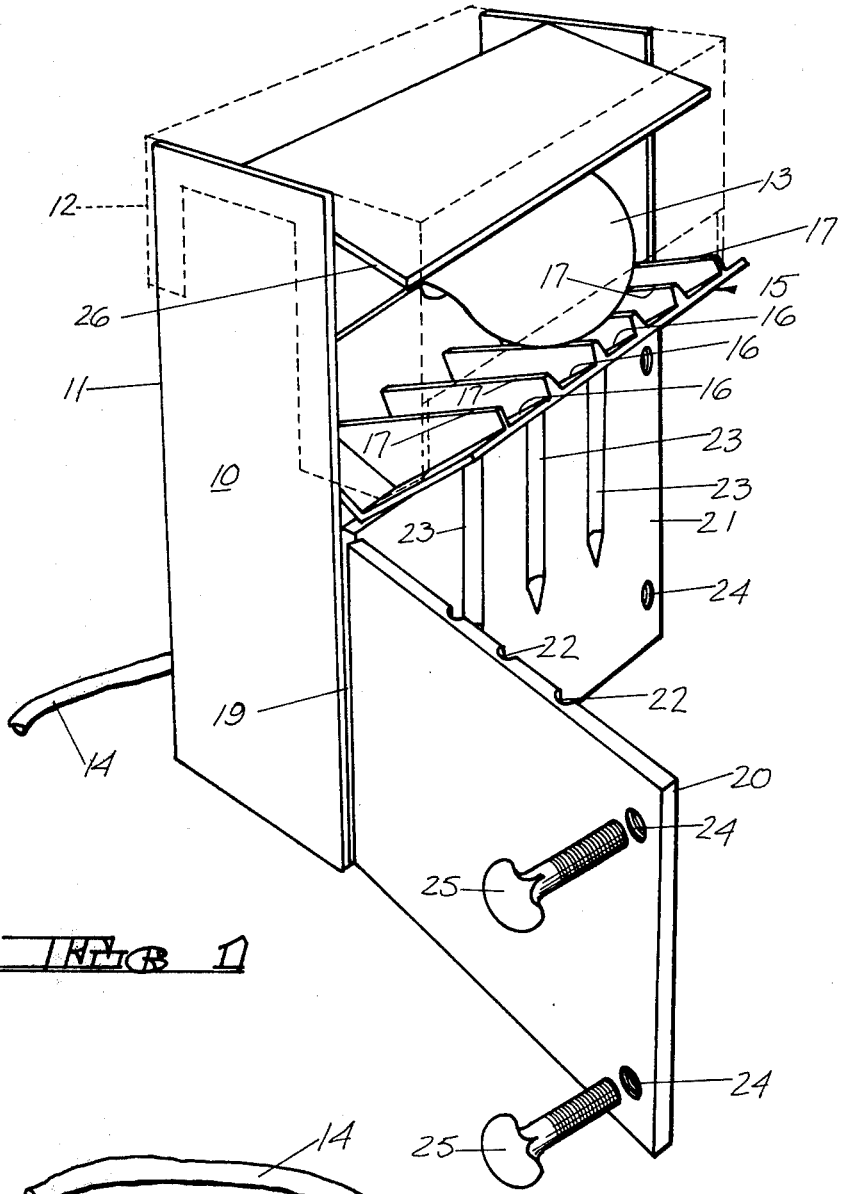
FIG. 1 is a perspective view, with some parts in phantom lines for clarity, of a mold apparatus embodying the invention.

Referring to the drawings, a housing indicated generally at 10 in FIG. 1 comprises a lower supporting base 11 and a removable top section 12. Means for supplying radiant and convective heat is indicated at 13. An incandescent 60 watt light bulb has been found to be highly effective for this purpose, although it will be evident that other equivalent heat supply means may be substituted. A connection to a standard 110 volt current (not shown) is indicated at 14.

Figure 2:
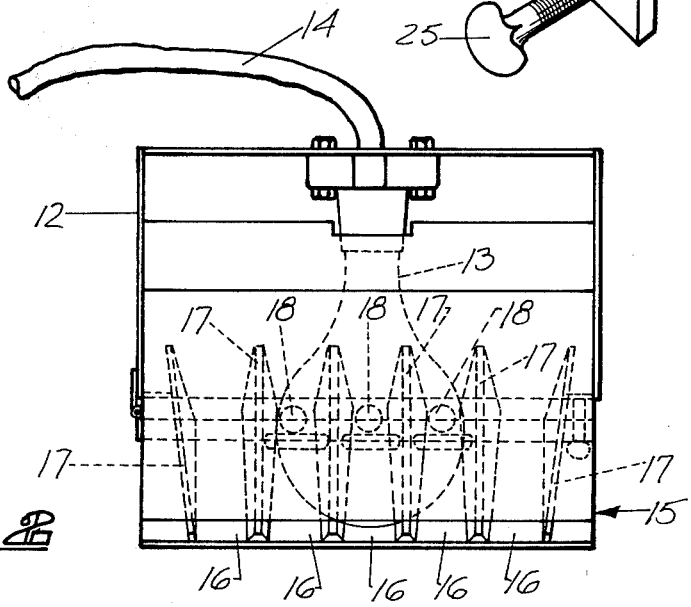
FIG. 2 is a top plan view of the apparatus of FIG. 1.
Figure 3:
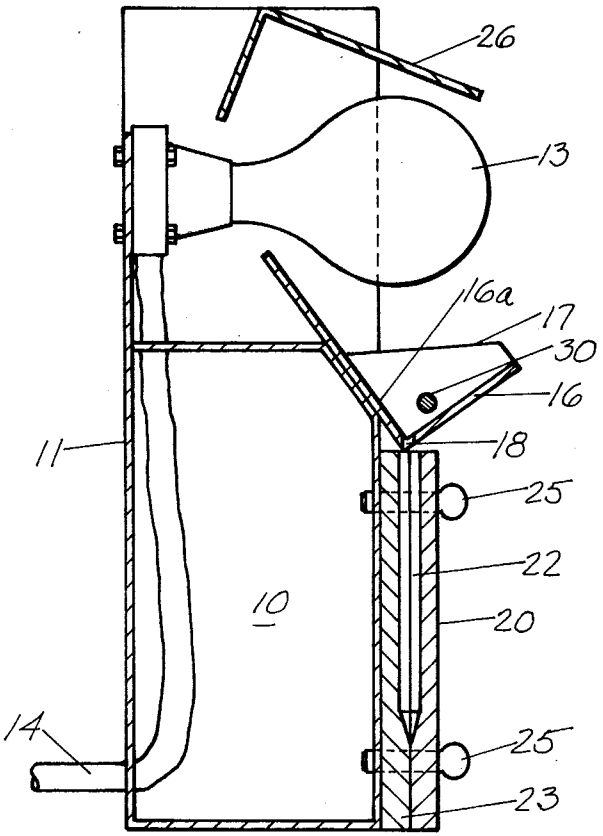
FIG. 3 is a vertical sectional view, taken along the line 3—3 of FIG. 4, of a part of the apparatus of FIG. 1.

Reservoirs for holding and melting wax particles are indicated generally at 15 in FIGS. 1–4. The reservoirs comprise a plurality of chutes 16 which slope downwardly and inwardly as perhaps best seen in FIG. 3. A plurality of upstanding ribs 17 separates the chutes from one another and prevents communication therebetween, in order to avoid mixing of waxes of different colors in adjacent chutes. Preferably the ribs 17 are so formed as to funnel the wax as it melts and flows by gravity toward the inner lowermost end of each chute. Orifices 18 are provided adjacent the lowermost end of each chute, as shown in FIGS. 2 and 3, through which molten wax may flow from each chute.

By way of exemplary embodiment five chutes 16 with ribs 17 separating each from the other are shown in the drawings, and three orifices 18 are shown in the centrally located chutes. However, it will be understood that the number of chutes may vary and that orifices may be provided in each chute, as desired.

A plurality of mold cavities is provided arranged beneath the chutes in such manner that one mold cavity communicates with each orifice 18. As shown in FIGS. 1 and 3 an outer mold half 20 and an inner mold half 21 are provided connected by a piano hinge 19 so as to permit closing thereof in opposed face-to-face relation. Outer mold half 20 is provided with a plurality of half mold cavities 22, while inner mold half 21 is provided with a plurality of half mold cavities 23. When the mold halves are moved into face-to-face relation the mold halves 22 and 23 are in registry by reason of the hinged connection thereof. Means are provided for releasably clamping the two mold halves in opposed relation. By way of exemplary embodiment the clamping means may comprise aligned threaded openings 24 in mold halves 20 and 21 which may be engaged by threaded bolts 25. It will be understood that other releasable clamping means may be used such as friction clamps, spring clips and the like.

Preferably a reflective surface indicated at 26 in FIGS. 1 and 3 is provided above the heat supply means 13 which may be of stainless steel or other material having a radiant heat reflective surface. As shown in FIG. 3 the reflector 26 is so positioned as to reflect heat downwardly into the reservoirs 15.

Figure 4:
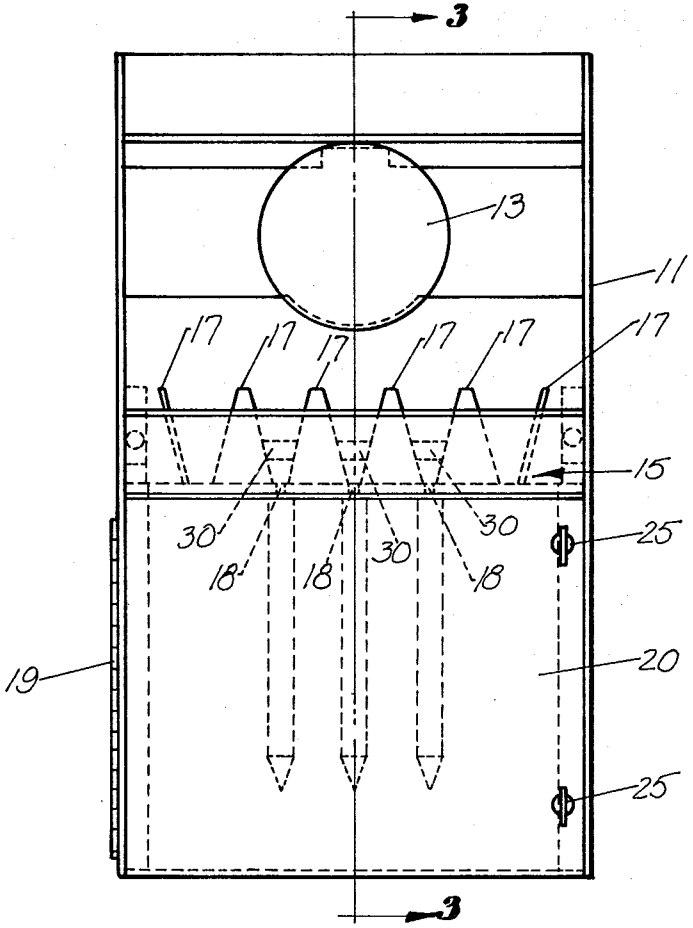
FIG. 4 is a fragmentary front plan view of the apparatus of FIG. 1.

It has been found that provision of a transverse bar or rod, indicated at 30 in FIGS. 3 and 4, in each chute, positioned slightly above and outwardly of each orifice 18 aids in directing the molten wax downwardly and into the orifices.

Channeling of molten wax into each orifice is also promoted by the configuration of ribs 17, as best seen in FIG. 2, to provide side edges of each chute which converge toward each orifice 18. It will further be noted that the inward end of each chute terminates in a sloping surface 16*a*, as shown in FIG. 3, which also insures flow of molten wax toward each orifice 18.

The housing sections 11 and 12 may conveniently be formed of sheet metal, while the mold halves 20 and 21 may be a resin material, such as polymerized methylmethacrylate, or polystyrene.

The manner of operation is believed to be evident from the above description of the apparatus. Briefly, the cord 14 is plugged into an electrical outlet, thus actuating the radiant and convective heat supply means 13. The mold halves 20 and 21 are clamped together in face-to-face relation, and wax fragments, such as broken or worn crayons are fed into one or more chutes 16. Since the outermost edge of the reservoir projects outwardly beyond the top section 12 the feeding of wax fragments can be effected without exposure to undue heat. The inwardly and downwardly sloping surfaces 16 insure that the wax particles will flow or slide downwardly or inwardly into contact with the transverse bars 30, which are preferably metallic and thus absorb heat readily from the heat supply means 13, thereby expediting the melting of the wax. As the wax melts it flows by gravity through orifice 18 downwardly into the mold cavity formed by mold cavity halves 22 and 23.

The wax in the mold cavities solidifies relatively rapidly since the mold cavities are shielded from the heat supply means by the chutes 16, surfaces 16*a* and ribs 17. In addition the mold halves are preferably formed of a material which is not heat absorbent. After solidification in the mold cavities, the clamp means 24, 25 are released to permit opening of mold half 20 on hinge 19. The newly molded crayons or other shapes may then be readily stripped from the half mold cavities 23.

Modifications may be made without departing from the scope of the invention. For example, molded shapes other than crayons, such as dolls or toy soldiers, could be made, and additional interchangeable mold halves may be provided for this purpose.

The embodiments of the invention in which an exclusive property or privilege is claimed are defined as follows:

1. Apparatus for reclamation of broken and worn crayons and molding thereof into new crayons and the like comprising means for supplying radient and convection heat; a housing surrounding said heat supply means, said housing comprising a base portion and a removable top section; a plurality of reservoirs positioned beneath said heat supply means, each said reservoir comprising a plurality of inwardly and downwardly inclined feed chutes for said broken and worn crayons, the uppermost end of said chutes projecting outwardly from said housing; an orifice in the lowermost, inner end of each said chute; a heat reflective surface secured in said housing above said heat supply means, whereby to reflect heat downwardly into said reservoirs; a plurality of mold cavities arranged beneath said chutes, each said cavity having an open upper end positioned beneath and in communication with one of said orifices; said mold cavities being provided in a pair of releasable mold halves assembled in face-to-face opposed relation, each mold half having a plurality of cavity halves therein in registry with cavity halves in the opposed mold half, said base portion supporting said reservoirs and mold cavities, and said top portion enclosing said heat supply means, said chutes and mold cavities being in alignment and being secured across an open end of said base portion and said chutes being out of communication with one another; and means for opening said mold cavities for releasing new crayons from said mold cavities.

2. The apparatus claimed in claim 1, including a transverse rod across each said chute positioned slightly above and outwardly of said orifice, said rod being formed of heat absorptive material.

3. The apparatus claimed in claim 1, wherein said means for releasing new crayons comprises a hinged mounting along one edge of said mold halves and clamp means along an opposite edge of said mold halves.

* * * * *